US009073087B2

(12) United States Patent
Abbott

(10) Patent No.: US 9,073,087 B2
(45) Date of Patent: Jul. 7, 2015

(54) INJECTOR MECHANISM

(71) Applicant: Kenneth Abbott, Tucson, AZ (US)

(72) Inventor: Kenneth Abbott, Tucson, AZ (US)

( * ) Notice: Subject to any disclaimer, the term of this patent is extended or adjusted under 35 U.S.C. 154(b) by 44 days.

(21) Appl. No.: 13/987,791

(22) Filed: Sep. 3, 2013

(65) Prior Publication Data

US 2015/0060336 A1 Mar. 5, 2015

(51) Int. Cl.
*B07B 4/00* (2006.01)
*B07B 4/02* (2006.01)
*B07B 11/06* (2006.01)

(52) U.S. Cl.
CPC .. *B07B 4/02* (2013.01); *B07B 11/06* (2013.01)

(58) Field of Classification Search
USPC ..... 209/132, 133, 139.1
See application file for complete search history.

(56) References Cited

U.S. PATENT DOCUMENTS

| | | | | |
|---|---|---|---|---|
| 3,643,404 | A * | 2/1972 | Ronning | 95/220 |
| 4,257,880 | A * | 3/1981 | Jones | 209/139.1 |
| 4,318,692 | A * | 3/1982 | Hess | 432/58 |
| 4,326,845 | A * | 4/1982 | Hess | 432/106 |
| 4,526,678 | A * | 7/1985 | Myhren et al. | 209/2 |
| 5,103,981 | A * | 4/1992 | Abbott et al. | 209/37 |
| 5,411,142 | A * | 5/1995 | Abbott et al. | 209/29 |
| 6,273,269 | B1 * | 8/2001 | Cordonnier et al. | 209/714 |
| 2003/0221996 | A1 * | 12/2003 | Svoronos et al. | 209/1 |
| 2005/0056313 | A1 * | 3/2005 | Hagen et al. | 137/3 |

* cited by examiner

*Primary Examiner* — Terrell Matthews
(74) *Attorney, Agent, or Firm* — Mark Ogram

(57) ABSTRACT

The invention employs a particle separation mechanism utilizing a generally circular passage using an air flow for the separation of particles. Ideally, within the passage is a conduit employing a hollow winding. Particles are introduced through an input end and drawn through the winding portion forcing, through centrifugal force, the particles to press against the exterior surface of the winding. Openings in the winding allow the particles to be flung from the winding into the circular passage either directly or via feed tubes.

17 Claims, 4 Drawing Sheets

15
10A
16
13
12
18
14
10B
17
11

INJECTOR MECHANISM

BACKGROUND OF THE INVENTION

This invention relates generally to particle separators and more particularly mechanisms used to inject the particles being separated.

Within a variety of industries, there is a need to separate particles based upon their size and density. Examples of such classification mechanisms include separating coal particles by size, sand from pebbles, seeds from debris, and the such. This is often done using screens or shaker tables.

Another form of separation mechanism includes the use of an airflow mechanism in which the mixed particles are deposited. The lighter particles are entrained in the airflow while the heavier particles precipitate from the airflow. One such example is described in U.S. Pat. No. 5,103,981, entitled "Particle Separator/Classification Mechanism" issued to Abbott, et al. on Apr. 14, 1992, and incorporated hereinto by reference.

Often, all of these mechanisms rely upon complex systems to deposit the mixture of particles in a controlled manner so that proper separation can be achieved. If too much mass is deposited, then the mechanism becomes overwhelmed and separation is thwarted. If too little mass is deposited, then the mechanism fails to operate at optimal throughput.

Control of the feed is a critical component and cannot be left up to a "hit or miss" type of arrangement. This requires much more control of the feed mechanism that can be optimally done manually.

It is clear there is a need for a more effective injector for particle separations.

SUMMARY OF THE INVENTION

The invention is a component of a particle separation mechanism. The particle separator uses a generally circular air passage having an airflow therethrough. The airflow is chosen to entrain the lighter particles while allowing the heavier particles to precipitate. A fan or other such mechanism is used to create the airflow.

Control of the fan is through a variety of mechanisms well known to those of ordinary skill in the art and includes, but is not limited to the mechanism described in U.S. Pat. No. 5,411,142, entitled "Air-flow Control for Particle Cleaning Systems" issued to Abbott et al. on May 2, 1995, incorporated hereinto by reference.

Within the air passage is a conduit having a hollow winding portion. In the preferred embodiment, the winding is totally contained within the air passage. This is accomplished through the use of a winding having a small diameter, or placing the winding in a "bellows" portion of the air passage separator.

In another embodiment, the winding is exterior to the air passage separator and the particles are directed from the winding to the air passage separator using feeder tubes.

The mixture of particles is introduced to the conduit via an input end. The mixture is contained within an input hopper and drawn from the input hopper through the winding using an air flow sufficient to entrain the mixture. In the preferred embodiment, a feed fan communicates with the output end of the conduit such that the fan creates an air flow through the input end to exit through the output end of the conduit As the particles travel through the winding, due to centrifugal force, the mixture is forced to an exterior surface of the winding where a series of holes allows some of the particles to be flung into the air passage, thereby feeding the mixture into the air passage's airflow for separation.

By adjusting the amount of particles being fed into the input end of the conduit and the amount of airflow within the conduit, the particles are selectively fed into the air passage for separation.

The particles which are not so fed into the air passage (i.e. escape from exiting through the holes) from the winding are deposited into an output hopper. From this output hopper, the particles may be discarded or, in the preferred embodiment, the particles collected in the output hopper are again deposited into the input hopper to again be fed into the conduit system for recycling until all of the mixture has been flung into the air passage in a controlled feed arrangement.

The holes through the winding are chosen to have a diameter and angle appropriate to encourage single particles to pass there through, thereby eliminating the possibility that the particles might "clump" and foil the operation of the air passage.

To eliminate any dust which might be generated by the process, the preferred embodiment utilizes an air filtration system obvious to those of ordinary skill in the art, including, but not limited to that described in U.S. Pat. No. number 5,271,750, entitled "Air Filtration System with Safety After-Filter" issued to Abbott et al., on Dec. 21, 1993; incorporated hereinto by reference.

The invention, and its various embodiments, will be more fully explained by the accompanying drawings and the following descriptions thereof.

DRAWINGS IN BRIEF

DRAWINGS IN DETAIL

Figure 1:
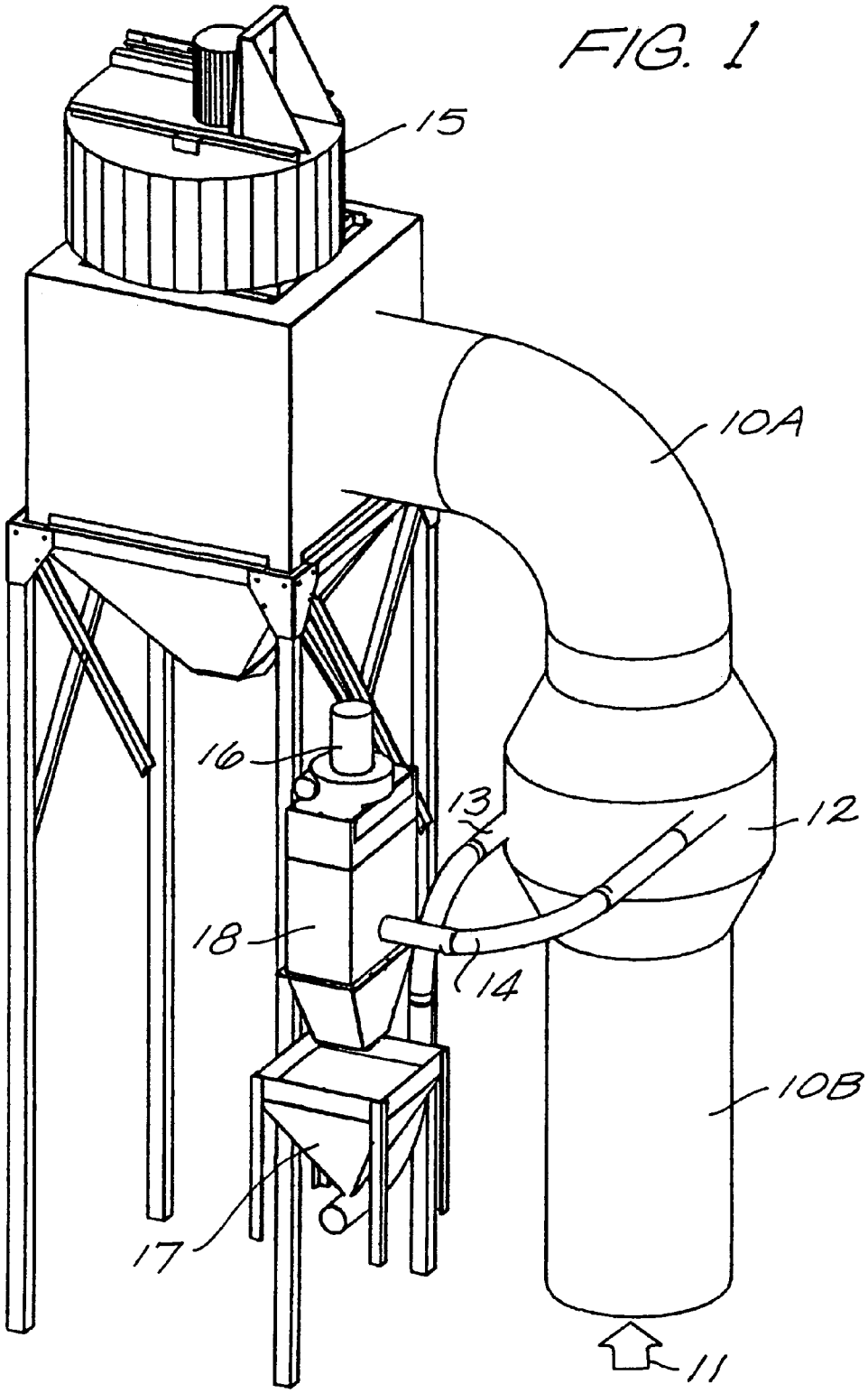
FIG. 1 is a perspective view of the preferred embodiment of the invention in use with a vertical separator.

FIG. 1 is a perspective view of the preferred embodiment of the invention in use with a vertical separator.

The separator has a circular passage formed by tubing 10A and 10B. Fan 15 draws an airflow through tubing 10A and 10*b* as illustrated by arrow 11. The airflow passes through tubing 10B, through bellows 12, and final through tubing 10A.

Particles, contained within hopper 17 are drawn by fan 16 through inlet 13 to be disbursed in bellows 12 via a windings (not visible in this illustration). Particles which are not dispersed are returned via outlet 14. The particles within hopper 17 are meant to be classified using the airflow 11 within the passage of tubing 10A and 10B.

Particles which escape being dispersed, are collected in output hopper 18 and are then "recycled" into input hopper 1 for subsequent dispersal.

Figure 2:
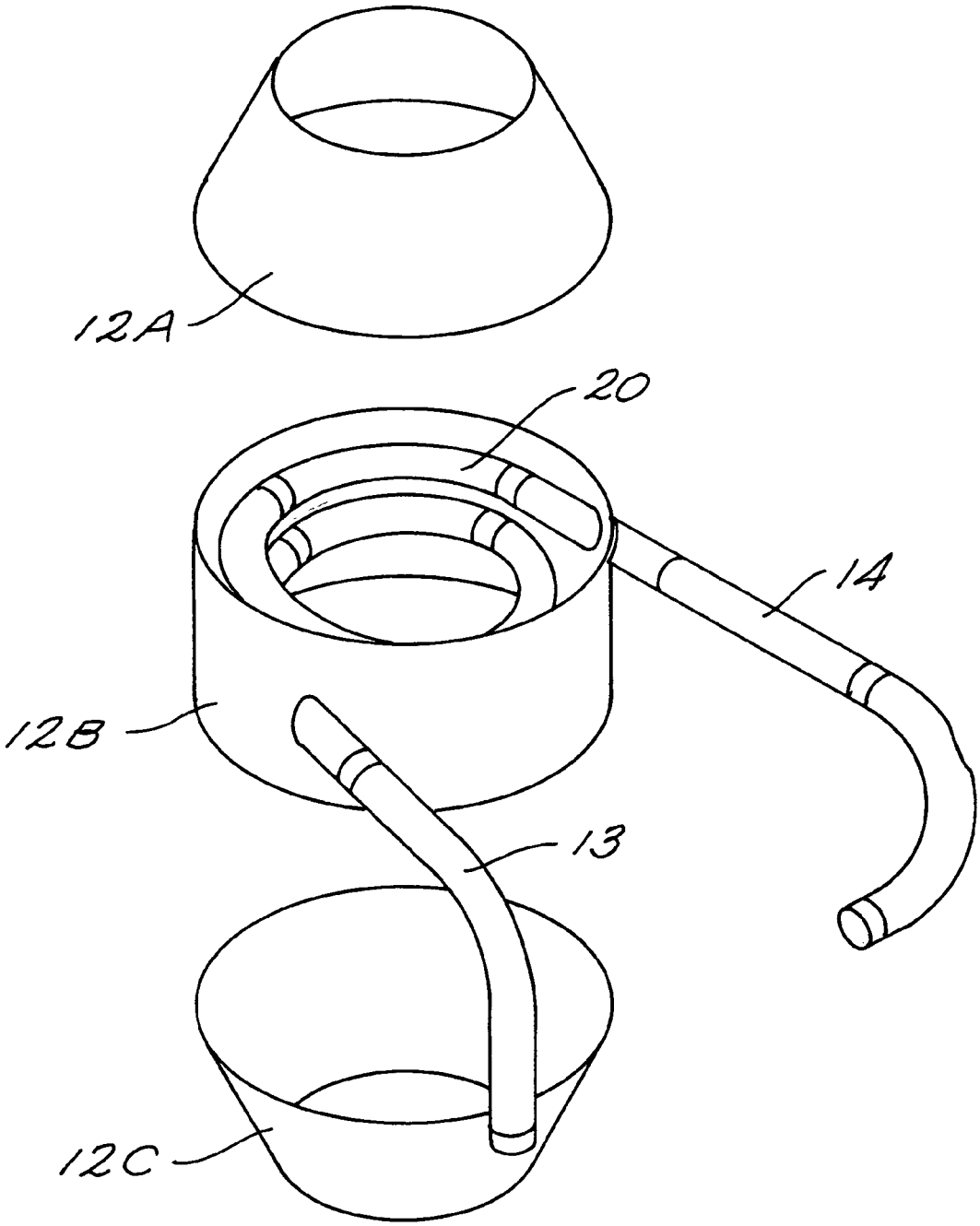
FIG. 2 is a blow-up view of the preferred feed mechanism shown in FIG. 1 contained with the bellows portion.

FIG. 2 is a blow-up view of the preferred feed mechanism shown in FIG. 1 contained with the bellows portion 12 (FIG. 1).

The bellows, as described above, is composed of an upper flange 12A (connected to tubing 10A of FIG. 1), lower flange 12C (connected to tubing 10B of FIG. 1), and ring 12B sandwiched between flange 12A and flange 12B.

Winding 20, in this embodiment, is contained within ring 12B and is distanced from the interior wall of ring 12B. Inlet 13 allows particles to be drawn into winding 20 and centrifugally flung against the interior wall of winding 20 and dispersed into the interior of ring 12B via holes (not shown) in the outer portion of winding 20.

Particles, which are not dispensed through the holes (not shown), are returned via outlet 14 for collection and subsequent recycling via this mechanism.

Figure 3:
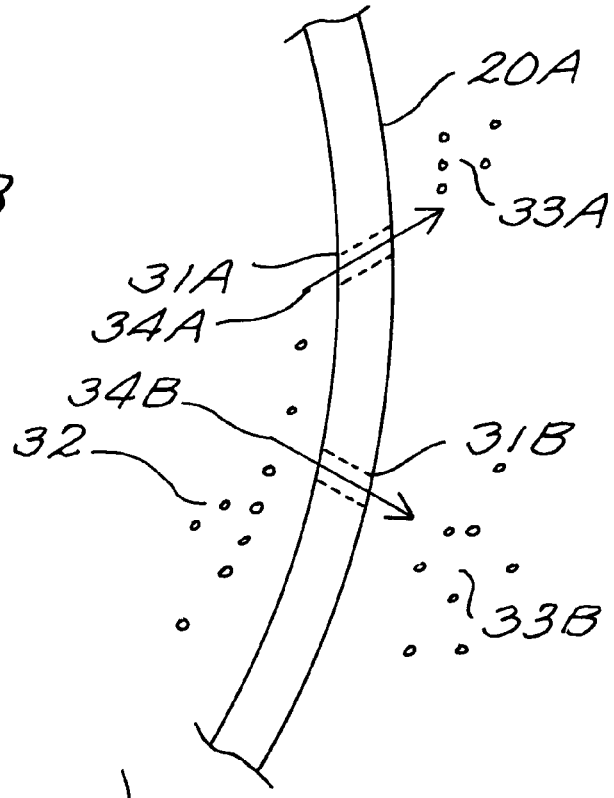
FIG. 3 is a cut-away view of the exterior wall of the winding portion of the feed mechanism.

FIG. 3 is a cut-away view of the exterior wall of the winding portion of the feed mechanism.

Wall portion 20A lies on the exterior portion of the winding discussed in FIG. 2. Holes 31A and 31B penetrate through wall portion 20A. Particles 32 are drawn through the winding and due to centrifugal force are pressed against the interior surface of the winding.

Particles 32 pressing against the exterior wall 20 are permitted to be flung through holes 31A and 31B as indicated by arrows 34A and 34B respectively to create a dispersal of the particles 33A and 33B into the ring 12B (not shown in this figure). This feeds the particles so that they are selectively entrained in the airstream in the separator.

The sizes of holes 31A and 31B are chosen to permit the particles to exit the winding and also provide for a mechanical operation to break up any "clumps" of particles which might exist.

Figure 4A:
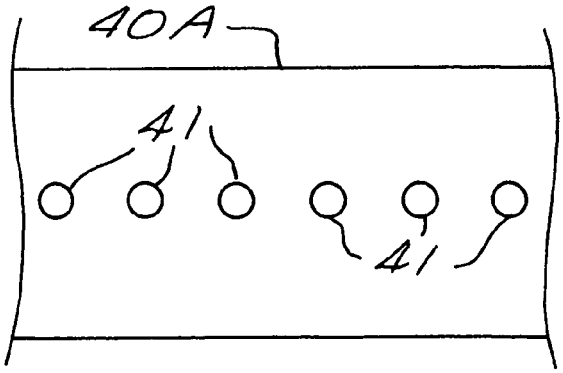
FIGS. 4A and 4B illustrate different openings in the winding portion.
Figure 4B:
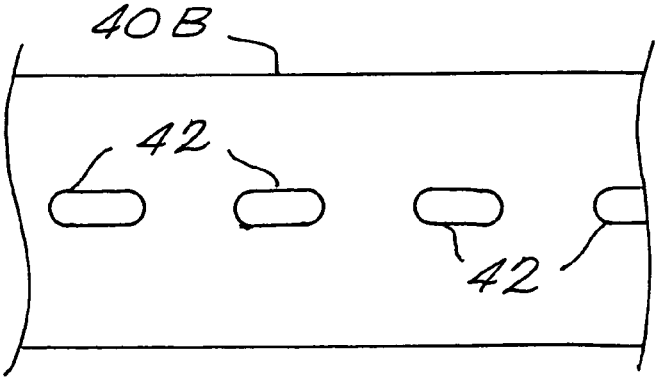

FIGS. 4A and 4B illustrate different openings in the winding portion. Viewing the exterior of the winding 40A, FIG. 4A illustrates the use of a series of holes 41 through which the particles are flung into the air stream.

FIG. 4B illustrates the placement of slots 42 which serve the same purpose. Those of ordinary skill in the art readily recognize a variety of other openings which will serve the purpose outlined herein.

Figure 5:
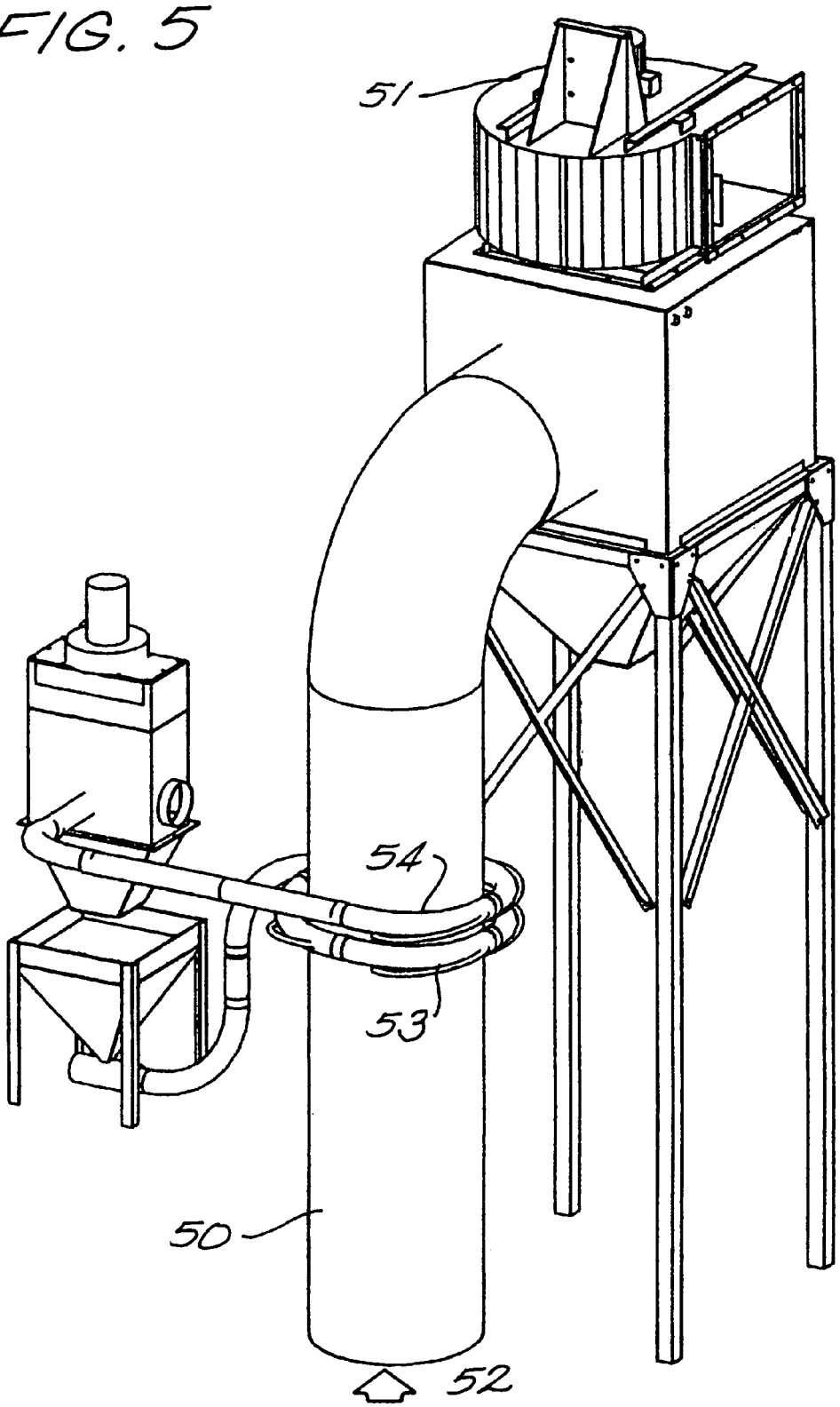
FIG. 5 illustrates an alternative embodiment of the feed mechanism.

FIG. 5 illustrates an alternative embodiment of the feed mechanism.

In this embodiment, vertical tube 50 has created therein an airflow 52 formed by fan 51. The particles are drawn through winding 54 and are directed to be injected into vertical tube 50 using feed tubes 53. In this manner, the particles are injected into the air flow for selective separation.

It is clear that the present invention provides enhanced injector mechanism.

What is claimed is:

1. A particle separation mechanism comprising:

a) a generally circular passage having an air flow therethrough;

b) a conduit having, 1) a hollow winding portion contained within said generally circular passage, 2) an input end receiving particles to be separated, said input end communicating with the hollow winding portion; and, 3) an output end for exhausting particles, said output end communicating with the hollow winding portion; and, c) a feed fan drawing air from the output end of the conduit such that said fan creates an airflow through said input end to exit through the output end of the conduit, said hollow winding portion of said conduit having openings arranged around an exterior surface of the circular conduit such that particles travelling through the circular portion conduit exit therethrough into the generally circular passage.

2. The particle separation mechanism according to claim 1, further including an input hopper containing the particles to be separated, said input hopper communicating with the input end of said conduit.

3. The particle separation mechanism according to claim 2, further including a collection hopper interposed between the output end of the conduit and said fan, said collection hopper configured to allow particles passing from the output end of the conduit to precipitate into the collection hopper.

4. The particle separation mechanism according to claim 3, further including a feed mechanism communicating particles from the collection hopper to the input hopper.

5. The particle separation mechanism according to claim 4, a) wherein the generally circular passage is arranged in a vertical manner; and, b) further including a separation fan creating a vertical airflow in said generally circular passage.

6. The particle separation mechanism according to claim 5, a) wherein the generally circular passage has an upper end and a lower end; and, b) further including a collection bin interposed to collect particles precipitating from the lower end of said generally circular passage.

7. A particle separation mechanism comprising:

a) a conduit having, 1) a hollow winding portion having openings arranged around an exterior surface thereof, 2) an input end receiving particles, said input end communicating with the hollow winding portion; and, 3) an output end for exhausting particles, said output end communicating with the hollow winding portion; and, b) a feed fan drawing air from the output end of the conduit.

8. The particle separation mechanism according to claim 7, further including an input hopper containing the particles to be separated, said input hopper communicating with the input end of said conduit.

9. The particle separation mechanism according to claim 8, further including a collection hopper interposed between the output end of the conduit and said fan, said collection hopper configured to allow particles passing from the output end of the conduit to precipitate into the collection hopper.

10. The particle separation mechanism according to claim 9, further including a feed mechanism communicating particles from the collection hopper to the input hopper.

11. The particle separation mechanism according to claim 7, further including feed tubes communicating particles exiting said openings of said hollow winding to a separator mechanism.

12. A particle separation mechanism comprising:

a) a passage having an air flow therethrough;

b) a hollow winding contained within said generally circular passage, said hollow winding portion having an input end receiving particles to be separated and an output end for exhausting particles, said hollow winding having exit ports arranged at selected locations around an exterior surface of the hollowing winding; and, c) a feed fan communicating with the output end of said hollow winding such that said fan creates an airflow through said input end to exit through the output end of the hollow winding.

13. The particle separation mechanism according to claim 12, further including an input hopper containing the particles to be separated, said input hopper communicating with the input end of said hollow winding.

14. The particle separation mechanism according to claim 13, further including a collection hopper interposed between the output end of the conduit and said fan, said collection hopper configured to allow particles passing from the output end of the hollow winding to precipitate into the collection hopper.

15. The particle separation mechanism according to claim 14, further including a feed mechanism communicating particles from the collection hopper to the input end of the hollow winding.

16. The particle separation mechanism according to claim 15, a) wherein the generally circular passage is arranged in a vertical manner; and, b) further including a separation fan creating a vertical airflow in said generally circular passage.

17. The particle separation mechanism according to claim 16, a) wherein the generally circular passage has an upper end and a lower end; and, b) further including a collection bin interposed to collect particles precipitating from the lower end of said generally circular passage.

* * * * *